US007480965B2

(12) United States Patent
Dilo et al.

(10) Patent No.: US 7,480,965 B2
(45) Date of Patent: Jan. 27, 2009

(54) CROSS LAPPER

(75) Inventors: Johann P. Dilo, Eberbach (DE); Joachim Leger, Eberbach (DE)

(73) Assignee: Oskar Dilo Maschinenfabrik KG, Eberbach (DE)

( * ) Notice: Subject to any disclaimer, the term of this patent is extended or adjusted under 35 U.S.C. 154(b) by 0 days.

(21) Appl. No.: 11/954,315

(22) Filed: Dec. 12, 2007

(65) Prior Publication Data

US 2008/0196207 A1 Aug. 21, 2008

(51) Int. Cl.
*D01G 25/00* (2006.01)

(52) U.S. Cl. ..... 19/163

(58) Field of Classification Search ..... 19/163; 100/80

See application file for complete search history.

(56) References Cited

U.S. PATENT DOCUMENTS

| | | | | |
|---|---|---|---|---|
| 3,877,628 | A | 4/1975 | Asselin | |
| 4,944,502 | A * | 7/1990 | Platzer et al. | 270/30.12 |
| 5,285,554 | A | 2/1994 | Jean | |
| 5,289,617 | A | 3/1994 | Jean | |
| 5,590,442 | A | 1/1997 | Hirschek | |
| 6,085,391 | A | 7/2000 | Schäffler | |
| 6,195,844 | B1 | 3/2001 | Jourde | |
| 6,550,107 | B1 * | 4/2003 | Jourde et al. | 19/163 |
| 7,401,771 | B2 * | 7/2008 | Steyer | 270/30.01 |

FOREIGN PATENT DOCUMENTS

| | | |
|---|---|---|
| EP | 0 517 563 B2 | 10/1995 |
| EP | 1 010 786 B1 | 9/2003 |
| EP | 1 367 166 A1 | 12/2003 |
| EP | 1 532 302 B1 | 4/2006 |
| EP | 1 717 357 A1 | 11/2006 |

* cited by examiner

*Primary Examiner*—Shaun R Hurley
(74) *Attorney, Agent, or Firm*—Jansson Shupe & Munger Ltd.

(57) ABSTRACT

A cross lapper for laying a fleece from a card web includes a laying carriage movable transversely with respect to an output conveyor belt and an upper carriage as well as a plurality of card web belts to guide the card web over the upper carriage and the laying carriage into a laying nip formed at the laying carriage, wherein a belt inlet is formed at the upper carriage over which a card web transport belt is guided, which from a lower end of an inlet path extends in the direction towards the laying carriage and is accompanied in parallel in this portion by an upper section of a first, endless cover belt guided through the laying carriage, said cover belt enclosing the card web together with same up to the laying carriage. The card web transport belt returned from the laying carriage to the upper carriage leaves the laying carriage above the upper section of a second endless cover belt passed through the laying carriage. This second cover belt forms a baffle surface within the laying carriage above the laying nip and in juxtaposition thereof, said baffle surface ensuring a safe guidance of the card web into the laying nip also case of higher card web transport speeds.

11 Claims, 1 Drawing Sheet

Detail X

CROSS LAPPER

CROSS REFERENCE TO RELATED APPLICATION

This application claims priority to European patent application EP 07 003 212.3, filed Feb. 15, 2007.

FIELD OF THE INVENTION

The present invention relates to the field of cross lappers for laying fleece from card webs.

BACKGROUND

From U.S. Pat. No. 6,085,391 B1, a cross lapper is known including a laying carriage movable transversely with respect to an output conveyor belt arranged below the output conveyor belt, and an upper carriage as well as a plurality of card web transport belts for transporting the card web over the upper carriage and the laying carriage into a laying nip formed at the laying carriage for depositing the card web on the output conveyor belt.

In the aforementioned cross lapper, a card web input region includes a belt inlet formed of web transport and laying belts (hereinafter card web transport belts), the belt inlet having a downwardly inclined input path with two adjacent belt sections of the card web transport belts. The belt sections joined at the entry into the belt inlet form a narrow inlet nip adapted to the web thickness and extend in the inlet path substantially in parallel or at an acute angle with respect to one another and so close together that they bilaterally guide or cover the web in the inlet path. In this cross lapper both card web transport belts are passed through the upper carriage and through the laying carriage.

U.S. Pat. No. 6,195,844 B1, EP 0 517 563 B2, U.S. Pat. Nos. 3,877,628, 5,285,554 B1, AU 2003254378 A1, U.S. Pat. No. 5,590,442 B1 and EP 1 010 786 B1 also describe cross lappers in which both belts transporting the card web into the laying nip at the laying carriage and depositing it on the output conveyor belt are passed through the upper carriage as well as through the laying carriage. The above-mentioned references are only a selection among a larger amount of references showing cross lappers of the same belt guidance structure.

The known constructions have a relatively complex extension of their card web transport belts, particularly on the upper carriage, where one of the card web transport belts supporting the card web winds around a deflection roller about more than 90° delimiting the inlet path at the lower end thereof. In the construction according to U.S. Pat. No. 6,085,391 B1, the arrangement is additionally complicated by the fact that the second card web transport belt is also passed through the upper carriage in a manner that it accompanies the first card web transport belt in the area of a downwardly inclined inlet path with a close spacing. All these known constructions have in common that the card web transport belt conveying the card web from the inlet of the cross lapper extends after leaving the laying nip at the laying carriage in a close distance to the output conveyor belt or even contacts the fleece deposited thereon, which can be disadvantageous for the fleece if the card web transport belt has a certain surface roughness due to the transport function that it is intended to have.

Thus, the applicant already proposed a cross lapper disclosed in US 2007/0175000 A1 having two main carriages movable transversely with respect to an output conveyor belt, in which the card web transport belt transporting the card web from the inlet of the cross lapper and through a downward inclined card web inlet extends through the upper carriage, but not also through the laying carriage, but is passed above same past the laying carriage. In the area between the upper carriage and the laying carriage this card web transport belt serves for covering the card web on the upper section of another, separate card web transport belt which extends through the laying carriage and is reversed there by 180° and whose lower section then covers the fleece formed on the output conveyor belt. This separate card web transport belt, which at the same time forms a first cover belt, is an endless belt and is tensioned by a tension carriage movable along with the laying carriage. A second endless cover belt also extends through the laying carriage, is reversed about 180°, mirrored with respect to the above-mentioned first cover belt and only serves for covering the laid fleece on the other side of the laying carriage. It is passed through the same tension carriage as the first card web transport belt.

Since the card web transport belt transporting the card web and covering same between the upper carriage and the laying carriage rests loosely on the card web only and extends past the laying carriage, it is not ensured at very high working speeds that the card web is drawn into the laying nip between the two deflecting rollers disposed in the laying carriage and wrapped by the cover belts. Moreover, the clamping pressure between the two transport belts enclosing the card web between the upper carriage and the laying carriage in a sandwich-type manner is not particularly constant and sometimes not high enough, and in the case of large path lengths of the laying carriage the transport belt can also flutter, thus leading to fiber blowing effects.

SUMMARY OF THE INVENTION

It is therefore the object of the invention to provide a cross lapper of the above-mentioned kind, which has a more simple but still reliable guide of the belts participating in the card web transport and the card web deposition.

According to the invention, the cross lapper for laying a fleece from a card web includes a laying carriage movable transversely with respect to an endless output conveyor belt above same, and an upper carriage movable above same transversely with respect to the output conveyor belt, with endless belts for guiding the card web to a laying nip located at the laying carriage, wherein a belt inlet is formed at the upper carriage over which a card web transport belt of the endless belts is guided, the card web transport belt extending from a lower end of the belt inlet in the direction towards the laying carriage and being accompanied in parallel in this section by a section of another belt of the endless belts at a tight distance, the card web being returned together with the second belt up to the laying carriage and through the laying carriage to the belt inlet at the upper carriage. In the cross lapper of the invention, a first deflecting roller and seventh and eighth deflecting rollers are freely rotatably supported in the laying carriage, over which rollers a first and a second cover belt of the endless belts are guided, respectively, each of the cover belts being guided over a movably supported fourth and eleventh tension roller, respectively, and which include lower sections arranged above the output conveyor belt, wherein an upper section of the first cover belt forms the belt section accompanying the card web transport belt between the upper carriage and the laying carriage, and that the seventh and eighth deflection rollers are arranged above one another and form a baffle surface along with the section of the second cover belt extending therebetween, wherein the upper section of the first cover belt and the adjoining section of the card web transport belt are directed towards this baffle surface, wherein a fourteenth deflecting roller adjacent to the baffle surface is rotatably supported in the laying carriage, through which the card web transport belt is guided to a fifteenth deflecting roller supported above the eighth deflecting roller in the upper carriage, from which the card web transport belt leaving the laying carriage is returned above the level of an upper section of the second cover belt to the upper carriage.

DISCUSSION OF THE INVENTION

The solution of the object on which the invention is based is characterized amongst others in that only one of the card web transport belts, namely the card web transport belt transporting the card web from the inlet of the cross lapper is passed through both main carriages of the cross lapper, namely through the upper carriage and the laying carriage. This card web transport belt does not leave the laying carriage through the laying nip but branches off from the card web before the latter enters the laying nip, and it is laterally guided out of the laying carriage above the laying nip. For covering the laid fleece, two separate endless cover belts are provided which wind around two deflecting roller arrangements by 180° horizontally opposing one another in the laying carriage, the cover belts being are guided to a common tension carriage, which is movable along with the laying carriage, and where they wind around two opposing tension rollers by 180°. The first one of these cover belts accompanies with an upper section the card web transport belt between the upper carriage and the laying carriage and covers by its lower section the laid fleece disposed on the output conveyor belt.

To ensure that the card web is transported into the laying nip, according to a further particularity of the present invention a vertically extending baffle surface is formed from the deflecting roller arrangement of the second cover belt together with the second cover belt within the laying carriage, the baffle surface being defined there by the second cover belt which is guided within the laying carriage over two deflecting rollers arranged at a vertical distance. The transport direction of the card web entering the laying carriage aims at this baffle surface. Due to this reason it is also no longer possible to guide the card web transport belt past the laying carriage but it is guided into the laying carriage and directly towards this baffle surface. The card web transport belt is therefore deflected upwardly by a deflecting roller in the laying carriage shortly in front of the baffle surface and it is subsequently returned by means of a further deflecting roller via the upper section of the second cover belt and later to the inlet region of the cross lapper.

Thus, the card web transport belt is guided in the laying carriage via two deflecting rollers supported on different levels. The deflecting rollers are wrapped by the card web transport belt at 90° or slightly less. Since the card web transport belt leaves the laying carriage on a level higher than the upper section of the second cover belt, these belts cannot contact one another and frictional effects cannot occur. This is also an essential aspect of the invention.

According to an advantageous alternative, the card web transport belt may be a perforated or sieve belt, since the card web transport belt has a transport function only but does not act as a cover belt at the same time. The escape of air from the card web when the card web is pressed onto the upper section of the first cover belt is enhanced thereby. The cover belt can therefore be smooth in the ideal case. However, it can also be provided with a surface structure which virtually produces a positive fit between the card web and the belt, which prevents slip and undefined sliding of the card web with relative movements between the belt and the card web such as a perforated belt, but which is more cost-effective than a perforated belt.

It is provided according to a further advantageous embodiment of the invention to arrange a suction means in the upper carriage on the side opposing the card web deposition surface of the card web transport belt formed as a perforated belt, the suction means generating a vacuum pressure at the perforated belt which helps to hold the card web on the perforated belt.

The tension carriage common for the two cover belts is preferably arranged below the output conveyor belt for space saving reasons and therefore moves in a direction opposing the movement of the laying carriage. The cover belts are preferably smooth in order not to harm the laid fleece upon contact.

The invention will now be described with reference to a preferred embodiment shown in the drawings.

In the above-mentioned drawings only the parts essential for explaining the invention are shown in order not to load the drawings with superfluous details. Particularly, a machine frame and the rails on which the movable carriages are movably guided in the machine frame are not shown.

DETAILED DESCRIPTION OF A PREFERRED EMBODIMENT

Figure 1:
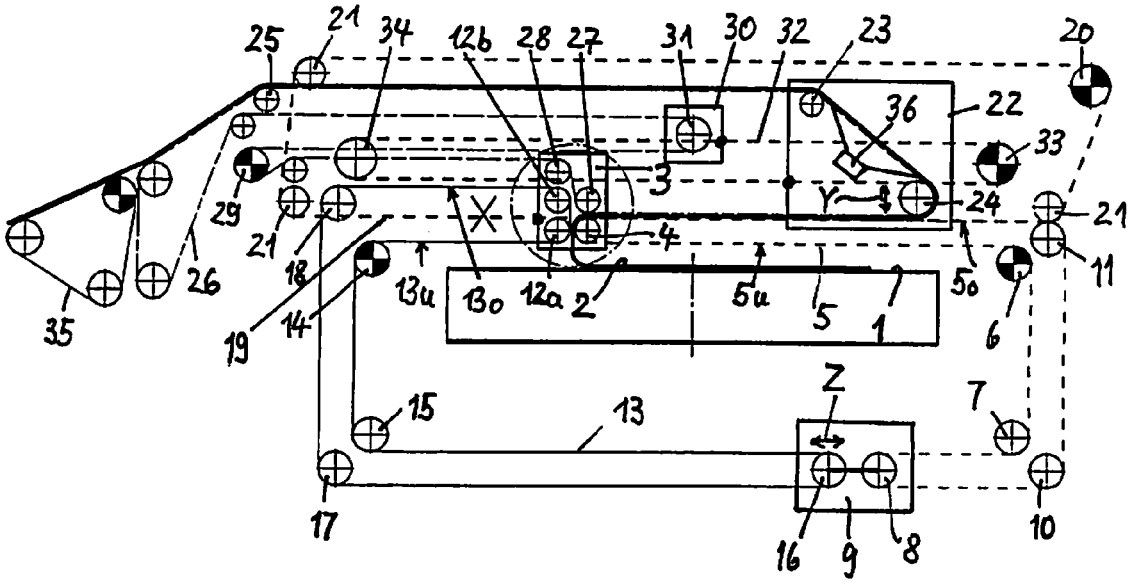
FIG. 1 shows a schematic view of an embodiment of the invention.

FIG. 1 shows a schematic view of an embodiment of the invention in a frontal view with respect to the outlet conveyor belt. An endlessly revolving output conveyor belt can be seen in FIG. 1, which is symbolically shown by a rectangle. The output conveyor belt 1 is determined to discharge a laid fleece in a transport direction extending perpendicular with respect to the drawing plane. A starting section of a card web 2 just laid rests on the output conveyor belt 1. A laying carriage 3 can be moved back and forth on rails (not shown) above the output conveyor belt 1. Five deflecting rollers are supported freely rotary in the laying carriage 3 according to FIGS. 1 and 2. A first deflecting roller 4 is partially wound around by a first cover belt 5 which has a lower section 5*u*, which according to FIG. 1 extends above the output conveyor belt 1 to a driven second deflection roller 6, through a further stationary third deflecting roller 7 and to a fourth deflecting roller 8, which is rotatably supported in a first tension carriage 9, which can be moved below the output conveyor belt 1 transversely thereto on rails (not shown). From the fourth deflecting roller 8 supported in the tension carriage 9 the first cover belt 5 extends over further stationary fifth and sixth deflecting rollers 10 and 11 back to the laying carriage 3. The driven third deflecting roller 7 is coupled with a motor (not shown) and is determined for driving the first cover belt 5 in different directions.

In a similar manner a seventh and an eighth deflecting roller 12*a* and 12*b* rotatably supported in the tension carriage 3 are partially wound around by a second cover belt 13 which is guided through a driven ninth deflecting roller 14 and a stationary tenth deflecting roller 15 to an eleventh deflecting roller 16 supported in the first tension carriage 9, the eleventh deflecting roller 16 being partially wound around by the second cover belt 13, from which the second cover belt 13 returns over further stationary twelfth and thirteenth deflecting rollers 17 and 18 to the laying carriage 3. The seventh and eighth deflecting rollers 12*a* and 12*b* are arranged above one another at such a distance that the section of the second cover belt 13 extending therebetween forms a baffle surface 13*p* at which the nip aims which is formed between the upper section 5*o* of the first cover belt 5 and an adjoining card web transport belt 26 by which the card web 2 is enclosed in a sandwich-type manner.

The second cover belt 13 has a lower section 13*u* which extends at a tight spacing above the output conveyor belt 1. The driven ninth deflecting roller 14 is coupled with a motor (not shown) and is adapted to drive the second cover belt 13 in different directions.

FIG. 1 shows a relatively large distance between the lower section 5*u* and 13 and the output conveyor belt 1. This shall facilitate overview. In practical application there is a very small spacing between these cover belts and the fleece deposited on the output conveyor belt 1, or the cover belts even contact the laid fleece, since they shall protect it against aerodynamic influences coming from the movement of the laying carriage. This contact can also be a small compression, wherein the compression is preferably set by height adjustment of the output conveyor belt 1. Thus, the cover belts 5 and 13 are preferably smooth at their side facing the laid fleece.

A chain or a toothed belt 19 is attached at the laying carriage 3, the chain or toothed belt 19 extending over a first drive gear 20 connected to a motor (not shown) and several deflecting pulleys 21. By the aid of this drive means the laying carriage 3 can be moved back and forth above the output conveyor belt 1 transversely to the transport direction thereof.

In a position elevated with respect to the height level of the laying carriage 3, an upper carriage 22 is displaceably supported on rails (not shown) in the machine frame transversely to the transport direction of the output conveyor belt 1. The upper carriage 22 has an upper deflecting roller 23 and a lower deflecting roller 24, which are laterally offset against one another. A card web transport belt 26, already mentioned, runs over these upper and lower deflection rollers 23 and 24, the card web transport belt 26 being supported by a fourteenth deflecting or support roller 25 stationarily supported in the machine frame. The card web transport belt 26 transports the card web 2 discharged by a card web generating means (not shown), which typically may be a card, from an inlet region of the cross lapper. In the area that is delimited by the upper and lower deflecting rollers 23 and 24 in the upper carriage 22 the card web transport belt 26 extends in a downwardly inclined manner. Starting from the lower deflecting roller 24 in the upper carriage 22 the card web transport belt 26 extends in parallel to the upper section 5*o* of the first cover belt 5 into the laying carriage 3. There, a fourteenth deflecting roller 27 is supported above the first deflecting roller 4. The fourteenth deflecting roller 27 deflects the card web transport belt about 90° or slightly less upwards and thus raises it from the card web. Above the seventh and eighth deflecting rollers 12*a*, 12*b* of the laying carriage 3 a fifteenth deflecting roller 28 is supported, which is wound around by the card web transport belt 26 at the same arc as the fourteenth deflecting roller 27, however, in the opposite direction.

The card web transport belt 26 leaves the laying carriage 3 above the upper section 13*o* of the second cover belt 13 and at a distance to same, it winds around a sixteenth roller 29 being a drive roller stationarily supported in the machine frame, and extends from there over a tension roller 31 supported in a second tension carriage 30, to then reach via a plurality of deflecting rollers stationarily supported in the machine frame to the inlet of the cross lapper.

The upper carriage 22 and the second tension carriage 30 are connected to one another by means of a second chain or a toothed belt 32, which extends over a second drive gear 33 connected to a motor (not shown) and another deflecting pulley 34, which are supported in the machine frame. A transversely upwardly extending supply belt 35 can further be seen in FIG. 1, which supplies the card web 2 to be laid to an input zone of the card web transport belt 26.

In the area between the lower deflecting roller 24 of the upper carriage 22 and the first deflecting roller 4 of the laying carriage 3 the card web transport belt 26 and the upper section 5*o* of the first cover belt 5 are guided in parallel to one another at a close distance so that a card web 2 transported by the card web transport belt 26 is enclosed in the area between the upper carriage 22 and the laying carriage 3 by the card web transport belt 26 and the upper section 5*o* of the first cover belt 5 in a sandwich-like manner. The card web 2 is supported by the cover belt 5, which, however does not have to take over a drive function at the card web supported by same in this area, since this is the job of the card web transport belt 26.

If the card web transport belt 26 is a perforated or sieve belt, a suction means 36 is advantageously provided in the upper carriage 22, as shown in the example, and as it is schematically shown in the drawing, which opposes the card web transport belt 26 in the area of the inlet path on the side opposing the card web deposition surface. In operation, a vacuum pressure built up by the suction means 36 helps to keep the card web 2 on the card web transport belt 26. The use of a perforated belt as a card web transport belt 26 is particularly advantageous, since it is possible by the aid thereof to press air out of the card web 2 in the area between the upper carriage 22 and the laying carriage 3, where two belts are guided in parallel and enclose the card web 2 therebetween in a sandwich-type manner, without the fibers being blown off laterally and the fiber orientation being disturbed by air flowing off.

It can be seen in the drawing that during operation, when the laying carriage 3 carries out a movement reciprocating over the output conveyor belt 1, the first tension carriage 9 carries out a movement in the opposite direction, since the loop lengths of the cover belts 5 and 13 are constant. Furthermore, the upper carriage 22 and its associated second tension carriage 30 carry out a movement in opposite direction, since they are operatively connected to one another by means of the chain or toothed belt 32. The second tension carriage 30 is required to keep the web transport belt 26 tensioned.

The kinematics of the upper carriage 22 and of the laying carriage fully 3 corresponds to those described in EP 0 865 521 B1. The movements of the laying carriage 3 and of the upper carriage 22 are adapted to one another in a manner that when supplying the card web 2 through the supply belt 35 with a uniform speed, a controlled deposition of the card web 2 can take place without stretching or upsetting within the cross lapper on the output conveyor belt 1 shown. The fact is also taken into consideration that the laying carriage 3 in the area of its movement reversal position must be decelerated to a stand still and must be accelerated again. If the card web 2 is supplied at a fluctuating speed, if for instance a cyclically operating extension unit is arranged in front of the supply belt 35, which generates an alternating thickness in the card web for the purpose of obtaining a transverse profiling of the laid fleece, a card web buffering within the cross lapper can be performed by means of an independent control of the movement of the upper carriage 22 and the laying carriage 3 in a known manner. In this case the buffering required for the compensation of the fluctuating laying carriage speed, is superimposed by a second buffering required for the compensation of the fluctuating card web speed. Depending on the adjustment of the time position of the stretching processes with the one of the laying carriage movements, these bufferings can possibly be inversely phased, i.e., they may partially or fully compensate one another.

Usually, the drives of the cover belts are controlled by means of the drive rollers 6 and 14 such that the cover belt lying rearwards in the movement direction of the laying carriage 3 simply rests on the laid fleece and does not move with respect thereto, while the cover belt lying forwards in the direction of movement of the laying carriage 3 moves forwards at a double speed with respect to the movement speed of the laying carriage 3.

Thus, it can very clearly be seen in FIG. 1 that among the cover belts 5 and 13 shown none of these belts is guided through the upper carriage 22. However, one of these cover belts, namely the first cover belt 5 participates in the card web transport with its upper section 5*o* in the area between the upper carriage 22 and the laying carriage 3, similar to the prior art. The guide of the belt in the cross lapper according to the invention is, however, very simplified compared to the prior art, which also facilitates exchange of these belts.

The cover belts 5 and 13 form a nip at the portion where they are deflected in the laying carriage 3 by their first and seventh deflecting rollers 4 and 12*a*, respectively. This nip was designated above as laying nip. During operation of the cross lapper the first cover belt 5 is driven such that its upper section 5*o* follows the movement of the card web transport belt 26, since both belts enclose the card web 2 on their way between the upper carriage 22 and the laying carriage 3. In order to prevent the generation of shear forces at the card web 2 by friction at the cover belts defining the output nip, the first cover belt 5 is preferably driven such that the circumferential speed of the first deflecting roller 4 in the laying carriage 3 is equally large as the circumferential speed of the second deflecting roller 12*a*, which, however, has the opposite sense of rotation.

Figure 2:
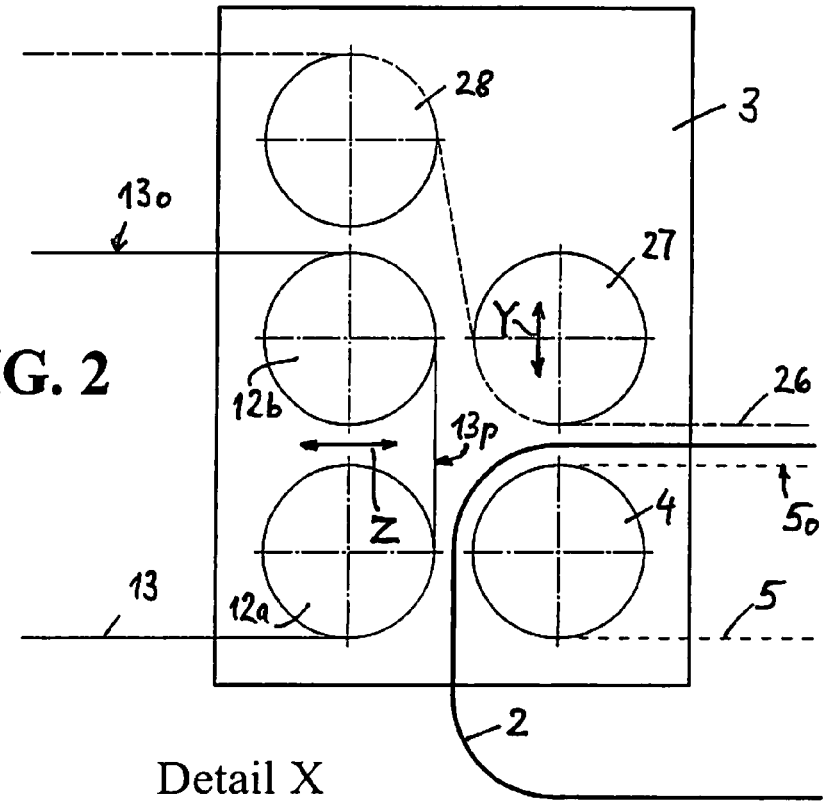
FIG. 2 shows a schematic view of the detail "X" of FIG. 1.

FIG. 2 shows as detail "X" of FIG. 1 in an enlarged scale the guide of the cover belts 5, 13 and the card web transport belt 26 within the laying carriage 3. The card web transport belt 26 and the first cover belt 5 entering the laying carriage 3 are guided in parallel to one another so that they enclose the card web 2 between each other. The first cover belt 5 winds around the first deflecting roller 4 in the laying carriage 3 by 180° and entrains the card web 2 to be laid into the laying nip between the first deflecting roller 4 and the seventh deflecting roller 12*a*. The second cover belt 13 winds around the seventh deflecting roller 12*a* and the eighth deflecting roller 12*b* supported above same in the laying carriage 3 about a total of 180°. It can clearly be seen that a baffle surface 13*p* is spanned by the second cover belt 13 between deflection rollers 12*a* and 12*b* onto which exactly the card web 2 aims, which is introduced by belts 5 and 26. If the inner hold of the card web 2 and the adhesion of same at the first cover belt 5 is not sufficient to properly let the card web 2 follow the arc around the first deflecting roller 4 so that a lift off from the cover belt 5 takes place, the second cover belt 13 moving in the direction of the laying nip ensures with its baffle surface 13*p* that the card web 2 is transported into the laying nip.

The card web transport belt 26 is lifted off from the card web 2 by the fourteenth deflecting roller 27 supported above the first deflecting roller 4 and is deflected from its way directed towards the baffle surface 13*p* and then extends over the fifteenth deflecting roller 28 supported above the eighth deflecting roller 12*b* in the laying carriage 3 and thereby gains a distance from the upper section 13*o* of the second cover belt 13.

The eighth deflecting roller 27 is preferably adjustable in height within the laying carriage 3, which is symbolized by the double arrow Y to be able to adapt the distance between the first and seventh deflecting rollers 4 and 27 and thus the distance between belts 5 and 26 extending thereover to the thickness of the processed card web. Furthermore, the upper carriage 22 and the laying carriage 3 are supported in a manner adjustable in height with respect to one another to be capable of adjusting the mutual distance of the belts 22 and 5 guided in parallel between the upper carriage 22 and the laying carriage 3. As an alternative to this, the lower deflecting roller 24 can be supported adjustable in height within the upper carriage 22, which is also symbolized by a double arrow Y in FIG. 1.

The distance between the first deflecting roller 4 on the one hand and the seventh and eighth deflecting rollers 12*a* and 12*b* on the other hand is preferably adjustable to vary the width of the laying nip, which is symbolized by the double arrow Z, possibly also with a respective adjustment of the eleventh deflecting roller 16 in the first tension carriage 9 in the direction of the arrow Z.

The invention therefore enables a very simple guidance of all belts participating in the card web treatment and has the additional advantage that the card web is deflected only twice within the cross lapper, namely at the upper carriage about a total of 180° and at the laying carriage about 90° before it reaches the output conveyor belt. Since on the one hand the card web transport belt can be optimized for the purpose that it is supposed to have, since it does not have to take over a cover function at the laid fleece, and the cover belts can be made smooth, since they do not participate in the card web drive, an optimal treatment of the card web in the cross lapper is ensured.

The invention claimed is:

1. A cross lapper for laying a fleece from a card web, said cross lapper comprising a laying carriage movable transversely with respect to an endless output conveyor belt above same, and an upper carriage movable above same transversely with respect to the output conveyor belt, with endless belts for guiding the card web to a laying nip located at the laying carriage, wherein a belt inlet is formed at the upper carriage over which a card web transport belt of said endless belts is guided, said card web transport belt extending from a lower end of the belt inlet in the direction towards the laying carriage and being accompanied in parallel in this section by a section of another belt of said endless belts at a tight distance, the card web being returned together with said second belt up to the laying carriage and through the laying carriage to the belt inlet at the upper carriage, wherein a first deflecting roller and seventh and eighth deflecting rollers are freely rotatably supported in the laying carriage, over which rollers a first and a second cover belt of said endless belts are guided, respectively, each of said cover belts being guided over a movably supported fourth and eleventh tension roller, respectively, and which include lower sections arranged above the output conveyor belt, wherein an upper section of the first cover belt forms the belt section accompanying the card web transport belt between the upper carriage and the laying carriage, and that the seventh and eighth deflection rollers are arranged above one another and form a baffle surface along with the section of the second cover belt extending therebetween, wherein the upper section of the first cover belt and the adjoining section of the card web transport belt are directed towards this baffle surface, wherein a fourteenth deflecting roller adjacent to the baffle surface is rotatably supported in the laying carriage, through which the card web transport belt is guided to a fifteenth deflecting roller supported above the eighth deflecting roller in the upper carriage, from which the card web transport belt leaving the laying carriage is returned above the level of an upper section of the second cover belt to the upper carriage.

2. The cross lapper of claim 1 wherein the two tension rollers of the cover belts are supported in a common tensioning carriage.

3. The cross lapper of claim 1 wherein the card web transport belt is a perforated belt.

4. The cross lapper of claim 3 wherein a suction means (36) is provided in the upper carriage in the area of an entrance path on a side opposing a card web deposition surface of the card web transport belt.

5. The cross lapper of claim 1 wherein the card web transport belt has a surface structure.

6. The cross lapper of claim 1 wherein the fourteenth deflecting roller in the laying carriage is supported in a manner adjustable in height.

7. The cross lapper of claim 1 wherein the laying nip has a width that is adjustable by adjustability of the mutual distance of the first and seventh deflecting rollers within the laying carriage.

8. The cross lapper of claim 1 wherein the output conveyor belt is supported in a manner adjustable in height.

9. The cross lapper of claim 1 wherein the upper carriage and the laying carriage are supported in a manner adjustable in height with respect to one another.

10. The cross lapper of claim 1 wherein a lower deflecting roller of the card web transport belt located in the upper carriage is supported within the upper carriage in a manner adjustable in height.

11. The cross lapper of claim 1 wherein the cover belts each have a smooth surface.

* * * * *

UNITED STATES PATENT AND TRADEMARK OFFICE

CERTIFICATE OF CORRECTION

PATENT NO. : 7,480,965 B2
APPLICATION NO. : 11/954315
DATED : January 27, 2009
INVENTOR(S) : Dilo et al.

It is certified that error appears in the above-identified patent and that said Letters Patent is hereby corrected as shown below:

Title Page, insert Item (30)

-- (30) Foreign Application Priority Data
Feb. 15, 2007 (EP).....EP 07 003 212.3 --

Signed and Sealed this
Tenth Day of July, 2012

David J. Kappos

David J. Kappos
*Director of the United States Patent and Trademark Office*